United States Patent [19]

Matsumoto et al.

[11] 4,365,394

[45] Dec. 28, 1982

[54] METHOD FOR PRODUCING AN INTERLACED MULTIFILAMENT YARN

[75] Inventors: Tadayuki Matsumoto, Mishima; Kozo Imaeda, Shizuoka; Masatoshi Mineo; Kiyoshi Nakagawa, both of Mishima, all of Japan

[73] Assignee: Toray Industries, Inc., Tokyo, Japan

[21] Appl. No.: 22,934

[22] Filed: Mar. 22, 1979

Related U.S. Application Data

[62] Division of Ser. No. 865,667, Dec. 29, 1977, abandoned, which is a division of Ser. No. 705,145, Jul. 14, 1976, Pat. No. 4,115,988.

[30] Foreign Application Priority Data

Jul. 18, 1975 [JP] Japan ..... 50-87372

[51] Int. Cl.[3] ..... D02G 1/20; D02G 1/16; D02J 1/08; D02J 1/16

[52] U.S. Cl. ..... 28/258; 28/219; 28/272; 28/274

[58] Field of Search ..... 28/220, 258, 272, 274, 28/276, 271, 275, 219

[56] References Cited

U.S. PATENT DOCUMENTS

| | | | |
|---|---|---|---|
| 3,140,526 | 7/1964 | Tlamicha | 28/219 X |
| 3,229,347 | 1/1966 | Tlamicha | 28/219 X |
| 3,312,052 | 4/1967 | Shiranezawa et al. | 28/220 X |
| 3,364,540 | 1/1968 | McIntosh et al. | 28/219 |
| 3,389,444 | 6/1968 | Fletcher et al. | 28/274 |
| 3,422,516 | 1/1969 | Barlow et al. | 28/274 |
| 3,571,868 | 3/1971 | Buzano | 28/275 |
| 3,645,080 | 2/1972 | Yamagata et al. | 28/220 X |
| 3,750,242 | 8/1973 | Lloyd et al. | 28/274 X |
| 3,831,360 | 8/1974 | Horvath | 28/220 X |
| 4,004,329 | 1/1977 | London, Jr. et al. | 28/274 |
| 4,070,815 | 1/1978 | Negishi et al. | 28/274 X |

FOREIGN PATENT DOCUMENTS

| | | | |
|---|---|---|---|
| 1155062 | 6/1969 | United Kingdom | 28/272 |

*Primary Examiner*—Robert Mackey

*Attorney, Agent, or Firm*—McAulay, Fields, Fisher, Goldstein & Nissen

[57] ABSTRACT

Method for producing an interlaced multifilament yarn comprising previously rubbing and scratching a material multifilament yarn with an intensity such that the individual filaments constituting the multifilament yarn are not substantially broken by a rotary rough surface member having sharp projections which are smaller than the cross-sectional diameter of the individual filaments of the multifilament yarn; then diffusing at least one jetted fluid, each jetted in the yarn running direction along a predetermined yarn passage from a jetting aperture of a supply conduit; and then impinging the diffused jetted fluid against the running material multifilament yarn so that the individual filaments of the multifilament yarn mostly vibrate in a direction which is substantially parallel to a plane defined by the yarn running direction and the fluid jetting direction.

5 Claims, 16 Drawing Figures

METHOD FOR PRODUCING AN INTERLACED MULTIFILAMENT YARN

The present invention is a divisional application of the copending application Ser. No. 865,667, filed Dec. 29, 1977, now abandoned, which application in turn is a divisional application of application Ser. No. 705,145, filed on July 14, 1976, now U.S. Pat. No. 4,115,988 and relates to a Method for Producing Interlaced Multifilament Yarns.

SUMMARY OF THE INVENTION

There have heretofore been known methods for imparting a gathering property to a multifilament yarn composed of a plurality of straight individual filaments or for improving a gathering property of a textured multifilament yarn composed of a plurality of crimped individual filaments by subjecting material yarns to an interlacing treatment so as to improve the operation adaptability such as pick resistance of these yarns.

When the conventional interlaced multifilament yarn or the conventional crimped multifilament yarn is used as the warp yarn for producing a fabric, since repeated stretching action is imparted to the warp yarn, the gathering property of these multifilament yarns is weakened. Consequently, it is essential to impart twists to such a yarn or to make the yarn compact by sizing before using it as the warp yarn. If such additional treatment is not applied, the individual filaments of the warp tend to separate so that an effective weaving operation can not be continued, or the quality of the fabric thus produced becomes lower grade.

One tendency of late is to produce a fabric utilizing a multifilament warp yarn which is non-twisted or non-sized, because of the introduction of a so-called interlaced multifilament yarn composed of a plurality of individual filaments interlaced with each other. However, as mentioned above, it is our experience that the gathering property of the conventional interlaced multifilament yarn is not sufficiently strong to bear the necessary repeated stretching during the weaving operation.

In order to solve the above-mentioned problems connected with using the conventional interlaced multifilament yarns, it is necessary to improve the quality of the yarn in such a way that the interlaced condition of individual filaments thereof will not be degraded even under repeated stretching in subsequent processes such as a warping process, weaving process etc. In addition, it is desirable to impart to the yarn a very uniform configuration of individual filaments interlaced with each other.

It is a primary object of the present invention to provide an interlaced multifilament yarn which eliminates the above-mentioned problems connected with using the conventional interlaced yarn and the interlaced crimped multifilament yarn and, therefore, it is the practical object of the present invention to provide a method for producing an interlaced multifilament yarn having the improved properties mentioned above.

To attain the purpose of the present invention, various experimental tests have been carried out by the inventors of the present invention. From these tests, it was found that, in the conventional interlacing treatment of a multifilament yarn by passing the yarn through a conduit where compressed fluid is jetted against the running yarn, if the jet fluid is controlled in such a way that, after jetting the fluid from an outlet of a fluid supply conduit, the jet fluid is firstly dispersed and thereafter jetted against the running yarn so as to be able to substantially vibrate the individual filaments of the yarn in a plane defined by the running direction of the yarn and the jetting direction of the fluid, the desired interlaced condition of the individual filaments can be created. It was also found that the above-mentioned interlacing treatment can be very effectively applied to textured multifilament yarns, such as a crimped multifilament yarn produced by a so-called false twisting apparatus.

The above-mentioned improved method for applying the interlacing treatment to the monofilament yarn is carried out by using an improved fluid treatment apparatus according to the present invention, comprising a body member, a straight yarn passage formed in the body member and a fluid conduit connected to the straight yarn passage via an enlarged space portion in such a way that the axis of the fluid conduit extends on a line crossing substantially perpendicularly the axis of the yarn passage. The fluid conduit is opened to the yarn passage via the enlarged space portion directly opened to the yarn passage and, therefore, the jet fluid is diffused in this space portion and supplied into the yarn passage in the diffused condition in the direction of the axis of the yarn passage.

From the experimental test results it was confirmed that the interlaced multifilament yarn produced in accordance with the present invention has a very much improved gathering property. It came as a surprise to the inventors that the degree of interlacing of individual filaments forming a multifilament yarn was remarkably increased when the yarn produced in accordance with the afore-disclosed method was repeatedly stretched, and that such particular condition of interlacing existed uniformly along the lengthwise direction of the yarn.

DETAILED EXPLANATION OF THE INVENTION

Figure 1:
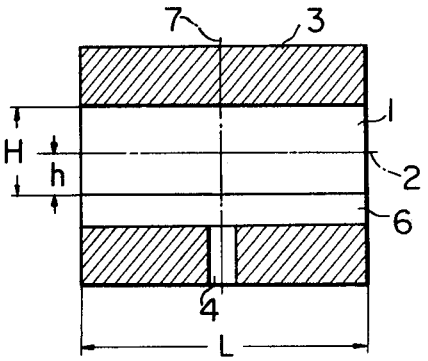
FIG. 1 is a longitudinal cross-sectional view of an embodiment of the interlacing nozzle utilized for the interlacing treatment apparatus, taken along the axis of the yarn passage thereof, according to the present invention.

Before explaining the method for producing the interlaced multifilament yarn according to the present invention, problems of a known apparatus for producing the interlaced multifilament yarn will be discussed.

Techniques of producing the interlaced multifilament yarn by applying the turbulent flow of a fluid is well known in the art. That is, a method for imparting vibration to individual filaments of a multifilament yarn, or a method of mingling individual filaments of a single or plural multifilament yarns, a method for imparting gathering property to a multifilament yarn so as to improve the operation adaptability in the weaving or knitting operation, by applying a turbulent flow of fluid, are well known.

For example, there are known an apparatus in which a yarn is passed through a resonance chamber and a nozzle, as disclosed in Japanese Patent Publication No. 1266/74, and an apparatus in which a fluid is withdrawn at the outlet of a resonance chamber and is recycled for treating a yarn again, as disclosed in Japanese Patent Publication No. 10689/64. However, in these apparatuses, it is difficult to control the ranges of vibration of the yarn while running and, further, since the treament is conducted in an open system, the fluid is diffused even into areas in which the yarn is not present and consequently, the treatment efficiency is very low.

An apparatus in which vibration of individual filaments of the yarn by jetting of the fluid towards the yarn is effected in controlled and limited regions is proposed in Japanese Patent Publication No. 12230/61. In this known method, however, since a fluid jetting aperture is directly opened to a yarn passage, the fluid acts on the yarn substantially at one point, and by the action of a turbulent flow generated by jetting of the fluid, the yarn or yarn-constituting individual filaments are randomly vibrated and deviated from the axial line of the fluid jetting hole with a high probability. As a result, the number of untreated open portions of the yarn is increased in the resulting treated yarn.

In general, in order to perform the fluid treatment at a high efficiency, it is preferred that the tension be lowered so long as respective individual filaments constituting the yarn can run stably, and this is especially desired in the case of crimped yarns having stretchability. When the above known apparatus is used for the treatment of crimped multifilament yarn, the fluid treatment becomes irregular and the occurrence of the above-mentioned opened portions is further enhanced, and in some cases, the yarn has opened portions distributed along its entire length.

When the interlacing treatment is carried out by using a fluid, it is also important that the fluid acting on the yarn running through the yarn passage should not be in the form of swirling streams. For attaining this feature, the relative positions of the fluid-jetting aperture and the yarn passage are important, and the configuration of the jetting aperture is important for determining working position of the stream of the fluid upon the running yarn, namely the acting point. In the above-mentioned known apparatus, however, since the fluid-jetting aperture is directly open to the yarn passage, a very high manufacturing accuracy of the jetting aperture is required and, hence, the manufacturing cost of the jetting apparatus becomes very high.

Further, Japanese Patent Application Laid-Open Specification No. 12145/74 discloses an apparatus in which the running yarn is restrictively maintained on a front face of the yarn passage to which a jetted fluid impinges. In this apparatus, if the restriction is loosened, the treatment becomes irregular as in the case of above-mentioned apparatus, and if the restriction is made strict, the moving range of individual filaments is narrowed and a sufficient fluid treatment effect cannot be obtained.

Japanese Patent Application Laid-Open Specification No. 125647/74 and the above-mentioned Japanese Patent Publication No. 12230/61 disclose an apparatus in which the acting point of the fluid is changed by forming the jetting aperture or a fluid conduit in the vicinity of the jetting aperture so as to have a square or V-shaped cross-section. However, when the jetting aperture is elongated in the direction of the yarn passage, if the width is not changed, the cross-sectional area of the jetting aperture is increased and the amount of the fluid consumed is also increased, resulting in economical disadvantages. If it is intended to narrow the width, the manufacturing accuracy of the jetting aperture is inevitably lowered.

Furthermore, it is very difficult to form a jetting aperture having a V-shaped section, and especially in the case of an apparatus for treating yarns utilized for ordinary garments, the size of the jetting aperture must be very small and it is practically impossible to form a jetting aperture having a V-shaped section.

Japanese Patent Application Laid-Open Specification No. 1340/73 discloses an apparatus in which there is formed in a fluid passage a portion having such a small cross-section as will provide a fluid flow rate approximating sonic velocity, an expanded portion for inflating the fluid is formed downstream of the small cross-sectional portion of the fluid passage and a void hollow portion is formed at the rear of the yarn passage in the opposite side of the jetting aperture, so that shock waves for the treatment of the yarn are generated. However, noises caused when such shock waves are generated raise various manufacturing problems yet to be solved and, further, since the configuration of a fluid conduit for generating such shock waves is very complicated and complex, it is very difficult to manufacture such a conduit.

Japanese Patent Publication No. 43787/72 discloses an apparatus in which a threading aperture is formed so as to make the threading operation of the material yarn into the yarn passage of the apparatus easy. In this apparatus, however, since the jetting aperture is substantially directly opened to the yarn passage, the above-mentioned defects involved in the conventional apparatus having a jetting aperture directly opened to the yarn passage are not overcome. Further, since the threading aperture is formed in the midportion of the fluid conduit, the fluid is lost through this threading aperture.

There is known an apparatus in which a threading aperture is formed in the tangential direction of the yarn passage, as disclosed in Japanese Patent Publication No. 41131/74. Also in this apparatus, a jetting aperture is directly opened to the yarn passage and, consequently, this apparatus also has the above-mentioned defects. In addition, since the threading aperture is opened to the yarn passage directly, possible escape of the yarn through the threading aperture cannot be completely prevented, and when the treatment is carried out under a low tension, or when a crimped yarn or the like having a stretchability is treated, such escape of the yarn through the threading aperture is especially conspicuous.

As pointed out hereinbefore, the stream line of the fluid, i.e., the acting point of the fluid and the flow amount of the fluid are determined by the configuration of the jetting aperture or nozzle. In the case where the fluid jetting aperture is directly opened to the yarn passage and the yarn is moved in the yarn passage, problems arise with regard to the wearing of the jetting nozzle by the yarn and the subsequent change of the flow of the fluid.

The inventors have conducted investigations with a view to solving the various problems mentioned above involved in the conventional fluid treatment apparatuses and, as a result, they have now arrived at the apparatus of the present invention to attain the purpose of the present invention.

The representative embodiment of the fluid treatment apparatus according to the present invention is hereinafter explained in detail with reference to FIGS. 1 and 2.

The apparatus is provided with a yarn passage 1 extending along a yarn passage axis 2 passing through a body member 3 and a fluid conduit 4 having a fluid conduit axis 7 crossing perpendicularly to the axis 2 and space portion 6 (a rectifying and diffusing portion) having one end to which the fluid conduit 4 is opened and the other end opened to the yarn passage 1. In this arrangement, a fluid jetted from the fluid conduit 4 is diffused in the rectifying and diffusing portion 6 along the extending direction of the axis 2 and the fluid performs an interlacing action on the individual filaments of the yarn continuously running through the yarn passage 1 without exerting any substantial false twisting action. More specifically, by forming the rectifying and diffusing portion 6 in such a manner that it is capable of diffusing the fluid in the direction of the axis 2, the working region of the jet fluid which acts directly upon the individual filaments of the running multifilament yarn from the vertical direction to the axis 2 is expanded in the direction of the axis 2, whereby the probability that each individual filament of the material yarn is present in the fluid-working zone is remarkably increased, so that the fluid treatment efficiency is remarkably enhanced.

Figure 5:
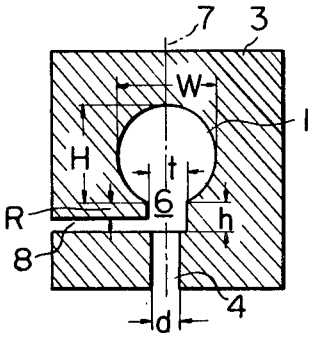
FIG. 5 is a lateral cross-sectional view of another modified embodiment of the interlacing nozzle provided with a threading-in slit, according to the present invention.

From the point of view of simplicity of design and manufacture of the fluid treatment apparatus, it is preferable that the shape of the section which is taken along a plane perpendicular to the axis 2 of the yarn passage 1 through which the yarn passes, namely the shape of the yarn passage 1 in FIG. 5, be such that the region where the rectifying and diffusing portion 6 is opened is substantially uniform in the direction extending along the axis 2. However, from a practical point of view, it is not absolutely essential that in the yarn passage 1, the shape of the section taken along a plane perpendicular to the axis 2 and passing therethrough should be uniform in the direction extending along the axis 2.

The term "substantially uniform sectional shape" referred to herein includes the cases where both ends of the rectifying and diffusing portion 6 are opened outside the body member in the direction extending along the axis 2 and, in order to prevent damage to the yarn or contact of the yarn with the outlet and inlet of the yarn passage 1, the corners of the inlet and outlet of the yarn passage 1 are rounded to provide curvatures or the inlet and outlet of the yarn passage 1 are enlarged or reduced in size.

The shape of the section, which is taken along a plane perpendicular to the axis 2, of the yarn passage 1 through which passage the yarn passes, is round and uniform in the direction of the axis 2, is most ordinary, and the yarn passage has such cross-sectional shape that it can easily be made.

The fluid conduit 4 has an axis 7 crossing perpendicularly to the axis 2, and one end of the fluid conduit 4 is connected to a fluid supply source and the other end is opened to the rectifying and diffusing portion 6. In general, the fluid conduit 4 has a round shape in the section taken which is along a plane where the axis 7 can be perpendicularly passed through and the fluid conduit 4 having such cross-sectional shape can easily be made. Of course, it is possible to provide a square, rectangular or other optional cross-sectional shape for the fluid conduit 4 by using auxiliary members so long as the above-mentioned problem concerning the manufacturing accuracy is not caused.

The fluid conduit 4 is opened to and communicates with one end of the rectifying and diffusing portion 6 and the other end of the rectifying and diffusing portion 6 is opened to and communicates with the yarn passage 1; namely, the rectifying and diffusing portion is formed in such a condition that the fluid coming from the fluid conduit 4 is diffused to perform an interlacing action on the multifilament yarn running continuously in the direction extending along the axis 2 without creating any substantial twisting action. The shape of the section, taken along a plane where the axis 2 perpendicularly passes thereto, of the rectifying and diffusing portion 6, namely the shape of the part 6 in FIG. 5, is not particularly critical, and it may be, for example, rectangular or trapezoidal. It is, however, preferred that the above-mentioned cross-sectional shape be substantially symmetrical with respect to the plane including the axes 2 and 7. However, the above-mentioned sectional shape need not be uniform in the direction extending along the axis 7. Incidentally, it is usual that the rectifying and diffusing portion 6 has a uniform rectangular sectional shape, taken along a plane where the axis 2 perpendicularly passes thereto, and such shape of the portion 6 can be easily made. Further, it is preferred that both the ends of the rectifying and diffusing portion 6 are opened outside at the longitudinal ends of the body member 3 as shown in FIG. 1, because the rectifying and diffusing portion of this type can easily be made.

Figure 3:
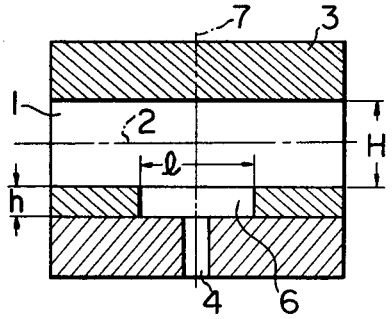
FIG. 3 is a longitudinal cross-sectional view of a modified embodiment of the interlacing nozzle, taken along the axis of the yarn passage thereof, according to the present invention.
Figure 4:
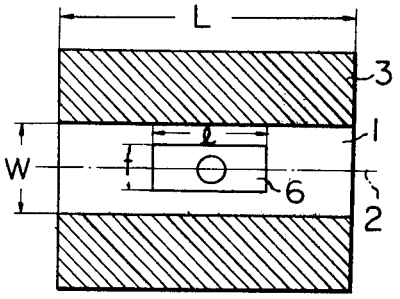
FIG. 4 is a cross-sectional plan view of the interlacing nozzle, taken along a plane perpendicular to the axis of the fluid supply conduit and also passing through the axis of the yarn passage, in FIG. 3.

As described hereinafter, the rectifying and diffusing portion 6 may be formed only in the vicinity of the axis 7 as shown in FIGS. 3 and 4. It is preferred that the fluid jetting aperture be formed substantially at the center of this rectifying and diffusing portion 6.

In an apparatus for treating yarns with a fluid jet, in general, by jetting a high-pressure and high-density fluid against the individual filaments of the running multifilament yarn, a fluid force acting substantially in the direction perpendicular to the axis of the multifilament yarn running through the yarn passage 1 is imposed on the individual filaments of the yarn to move them in the direction perpendicular to the axis of the yarn so as to entangle them with one another. This movement of the individual filaments may be regarded as a vibration about the axial line of the running yarn. It is understood that the higher the frequency of the individual filaments crossing the axial line of the running yarn, namely the frequency of the individual filaments undergoing the action of the fluid in the direction vertical to the yarn axis, the higher efficiency of interlacing the individual filaments. Accordingly, the interlacing effect is highest at the point where the fluid jetted from a fluid conduit acts directly on the filamentary yarn, and the effect by the action of the fluid at other points is a subsidiary effect. In other words, the broader the region where the fluid acts directly on the yarn, the higher treatment efficiency.

In the above-mentioned conventional fluid treatment apparatuses, the region where the fluid acts on the yarn in the direction vertical to the yarn axis is substantially limited to a point on the axial line of the fluid conduit and, hence, it is very important that the movement of the individual filaments of the running yarn be maintained restrictively on the axial line. Since the highest interlacing effect is obtained when the individual filaments are moved in such directions that they expel one another, if the space defining the moving region of the individual filaments, for example, the sectional area of the yarn passage, is too small, sufficient interlacing is not caused. However, if the moving space for the individual filaments is broadened in order to avoid this disadvantage, the individual filaments of the yarn deviate from the axial line of the fluid conduit with increased probability and the frequency at which the individual filaments undergo directly the action of the fluid jetted from the fluid conduit is lowered, resulting in reduction of the interlacing effect.

In contrast, in the apparatus of the present invention, since the rectifying and diffusing portion 6 is formed, as pointed out hereinbefore, so that the fluid is diffused in the direction of the axis 2, the region where the fluid stream acts substantially directly in the direction vertical to the axis of the multifilament yarn is expanded in the direction of the axis 2, and the probability that the individual filaments are present in the fluid-acting zone, is increased and the treatment efficiency is, therefore, enhanced.

It is possible to increase the stream of the fluid in the direction of the axis 2 by elongating the shape of the fluid jetting aperture in the direction of the axis 2 as disclosed in Japanese Patent Publication No. 12230/61. In this case, however, as pointed out hereinbefore, it is quite difficult to reduce the quantity of the fluid and improve the manufacturing accuracy. It is also possible to change the stream of the fluid by forming a throttling or diffusing portion on the jetting aperture of the fluid conduit or in the vicinity thereof as disclosed in Japanese Patent Application Laid-Open Specification No. 125647/74. In this case, however, it is difficult to make such fluid conduit and improve the manufacturing accuracy. More specifically, in the fluid treatment apparatus of this type, the dimensional accuracy of the fluid jetting aperture is very important, and a slight error results in a large change in the flow amount of the fluid and deviation among a plurality of identical apparatus mounted on a machine becomes conspicuous.

In contrast, in the apparatus of the present invention, a jetting aperture having a special shape or configuration need not be used at all, but any jetting aperture having a customary shape can be applied to the apparatus of the present invention. Further, as pointed out hereinbefore, the region where the fluid acts on the filamentary yarn is broad and the shape of the stream of the fluid can be formed so as to attain the highest interlacing effect. Accordingly, deviation among a plurality of individual apparatus mounted on a machine caused by the manufacturing accuracy is remarkably reduced over the conventional apparatus where a jetting aperture is directly opened to the yarn passage.

As hereinbefore explained, in the method for producing interlaced multifilament yarn by applying the fluid treatment, when the material multifilament yarn passes through a straight yarn passage formed in an interlacing nozzle member, a compressed fluid in diffused condition impinges on the yarn in a substantially vertical direction to the straight yarn passage in such a condition that the compressed fluid, jetted from a supply conduit formed in the interlacing nozzle, is diffused along a direction parallel to the straight yarn passage in the rectifying and diffusing space formed between the outlet of the supply conduit and the straight yarn passage and, consequently, very effective vibration of individual filaments of the running material yarn about the axis of the straight yarn passage is created in a portion of the straight yarn passage facing the rectifying and diffusion space so that very stable and effective interlacing of individual filaments of the running yarn can be created.

The fluid treatment apparatus according to the present invention will now be illustrated in detail with reference to FIGS. 3, 4, 5 and 6.

In the embodiment shown in FIGS. 3 and 4, an outline of construction thereof was hereinbefore presented. The dimensions of the component elements of the interlacing nozzle are defined as follows. That is, with respect to the section taken along a plane where the axis 2 of the yarn passage 1 passes therethrough at the point where the rectifying aand diffusing portion 6 crosses the extended axis of the fluid conduit 4, the maximum width of the yarn passage 1, the maximum height thereof, the maximum height of the rectifying and diffusing portion 6 and the width of the fluid conduit are designated as W, H, h and d, respectively. With respect to the portion at which the rectifying and diffusing portion 6 encounters the yarn passage 1, the maximum length in the direction extending along the axis 2 is designated as l and the maximum width in the direction parallel to a plane where the axis 7 of the fluid conduit 4 passes perpendicularly therethrough is designated as t as shown in FIG. 4. The fluid coming from the fluid conduit 4 is diffused in the rectifying and diffusing portion 6 in the direction of the axis 2 and in the direction vertical to the plane including the axes 2 and 7. However, if diffusion of the fluid in the direction perpendicular to the plane including the axes 2 and 7 is relatively increased and the density of the fluid after diffusion is lowered, the interlacing effect is reduced. Accordingly, it is preferred that t be less than ⅓ of l, especially less than 1/5 of l. In FIG. 4, the relative positions of the fluid conduit 4 and the rectifying and diffusing portion 6 may be changed with respect to the direction extending along the axis 2 of the yarn passage 1, so long as the effect of the present invention is not adversely influenced.

It is preferred that the height h of the rectifying and diffusing portion 6 be 0.3 to 20 times t, preferably 0.5 to 10 times t. When h is smaller than 3/10 of t, diffusion of the fluid in the direction extending along the axis 2 is insufficient, and the fluid acts substantially at one point and wearing of the fluid jetting nozzle takes place. If h is more than 20 times as large as t, good results are not obtained because the energy of the fluid reaching the yarn passage 1 is reduced.

Figure 6:
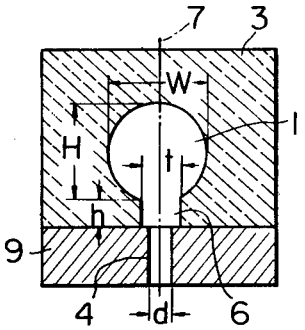
FIG. 6 is a lateral cross-sectional view of further modified embodiment of the interlacing nozzle formed with two component elements, according to the present invention.

The maximum width W of the yarn passage 1 can be changed in a broad range, but in order to maintain the movement of the individual filaments of the running yarn restrictively in the yarn passage 1 and ensure a sufficient moving space for the individual filaments of the running yarn 1, it is necessary that W should be not smaller than t. It is preferred that W is 1.2 to 10 times t. The maximum height H may be changed broadly in a customarily adopted range as well as the maximum width W. It is, however, preferred that the maximum width W be 0.2 to 5 times the maximum height H. The width d of the fluid conduit in the direction perpendicular to the axis 2 is ordinarily smaller than the width of the rectifying and diffusing portion 6 at the point where the fluid conduit encounters the rectifying and diffusing portion 6. However, if the interlacing nozzle is constructed by assembling parts as shown in FIG. 6, the width d can be made larger than the width of the rectifying and diffusing portion according to need. However, when a groove or space such as slit 8 for threading the material yarn into the yarn passage 1 is formed at the point where the fluid conduit encounters the rectifying and diffusing portion 6 as shown in FIG. 5, it is preferred that the width d be not larger than 2 times the width of the rectifying and diffusing portion 6 at the encountering point.

In the embodiment shown in FIG. 5, the slit 8 for threading the running yarn into the yarn passage 1 may be extended from the point where the rectifying and diffusing portion 6 encounters the fluid conduit 4 to the yarn passage 1 and be opened to the rectifying and diffusing portion 6. In order to effectively prevent escape of the yarn through the slit 8, it is necessary that the minimum distance R from the top edge of the opening of the slit 8 in the diffusing portion 6 to the point where the yarn passage encounters the diffusing portion 6 should be at least ($0.2\times h$). Further, in order to prevent escape of the fluid from the slit 8, it is necessary that the slit width R of the slit 8 at the opening in the diffusing portion 6 should be smaller than ($0.5\times h$), especially smaller than ($0.4\times h$), when the opening is substantially uniform with respect to the direction of the axis 2.

Figure 7:
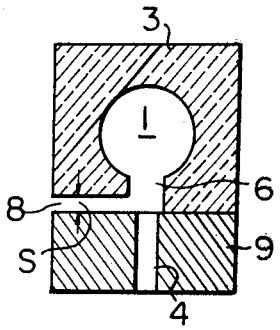
FIG. 7 is a lateral cross-sectional view of a modified embodiment of the interlacing nozzle shown in FIG. 6.

Still another preferred embodiment of the fluid treatment apparatus that is, the interlacing nozzle, of the present invention is illustrated in FIG. 7.

As illustrated in FIGS. 6 and 7, a body 3 having a yarn passage 1 may be combined with a member 9 having a fluid conduit. When the yarn passage including body 3 is made of a metal, a problem of wearing arises, and in view of the manufacturing accuracy, the material for the fluid jetting apparatus is limited. Accordingly, it is preferred that the member 9 provided with the fluid passage 4 be made of a metal and the body 3 provided with the yarn passage 1 be made of a ceramic material.

When a groove or slit for threading the running yarn into the yarn passage is formed as shown in FIG. 7, from the point of view of ease of production, it is preferred that the members be combined so that the slit be formed on the plane where the fluid conduit of the member 4 is opened.

The apparatus of the present invention may be applied, depending on the intended object, to any of the spinning processes; the spin-draw process; the drawing process; the texturing process, such as the false twisting process, the drawing-false twisting process, and; the warping process. Two or more yarns can be processed simultaneously in the apparatus of the present invention. The apparatus of the present invention is effective for the fluid treatment of such multifilament yarns as polyamide, polyester, polyacrylonitrile, acetate and glass multifilament yarns and combinations thereof. Air maintained at room temperature is most preferred as the fluid that is used in the present invention. In the present invention, other gases and liquids such as heated air, steam, nitrogen gas and carbon dioxide gas may be used depending on the intended object. It is preferred that the pressure of the fluid be in the range of from 0.2 to 15 $kg/cm^2G$, but a higher or lower fluid pressure may be used according to need. Fluid pressure as high as 15 $kg/cm^2G$ may be used. In the embodiments shown in the drawings, the fluid conduit is formed substantially perpendicular to the yarn passage, but in the present invention, the fluid conduit may optionally be inclined so that the fluid acts on the yarn in parallel to or in the opposite direction to the advancing direction of the running yarn, whereby an aspirator effect or reverse aspirator effect can be attained.

In the embodiments shown in the drawings, one jetting aperture is formed, although it is possible to utilize two or more apertures in a confronting manner or in parallel. However, in order to reduce wasteful consumption of the fluid, it is preferred that the number of jetting apertures be 1 or 2.

Further, in the embodiments shown in the drawings, one yarn passage and one fluid conduit are formed. In the present invention, two to several blocks, each including one yarn passage and one fluid conduit, can be utilized.

The effects attained by the apparatus of the present invention are as follows:

(1) Uniform interlacing action can be imparted to a multifilament yarn at a high efficiency without any substantial twisting action.

(2) When the fluid treatment is conducted at a treatment speed customarily adopted in the conventional apparatus, the consumption of the fluid can be remarkably reduced. Further, the treatment speed can be remarkably elevated.

(3) Wearing of the fluid jetting nozzle by frictional contact with the yarn can be reduced.

(4) Even if a slit for threading the yarn into the yarn passage of the interlacing device is formed, escape of the yarn from the yarn passage through the slit can be effectively prevented.

To find the best condition of the apparatus of the present invention, several experimental tests were carried out as described in the examples below. The present invention will now be described in detail by reference to the examples, which by no means limit the scope of the invention.

In the examples, the weaving adaptability is expressed in terms of the number of fluffs causing exchange of warps per piece of fabric 50 m long, and the weaving adaptability intended in the present invention is one fluff per piece or lower. In Examples 2 to 5, a CF value is adopted as a criterion for evaluating the degree of interlacing, and each CF value is an average value obtained by conducting the measurement 20 times.

Interlacing treatment apparatuses shown in Table 1 were employed in the examples. In each apparatus, either the yarn passage 1 or the fluid conduit 4 had a round lateral cross section, and the fluid jetting aperture was opened to the rectifying and diffusing portion 6 or the center of the yarn passage 1.

In the interlacing nozzle identified by A to E and G in Table 1, according to the present invention, the rectifying and diffusing portion 6 had a rectangular cross section, which was uniform with respect to the direction extending along the axis 2 of the yarn passage 1, and both ends of the rectifying and diffusing portion 6 were open toward the outside of the body member 3.

In the interlacing nozzles identified by A to F, the axis 2 of the yarn passage 1 crossed rectangularly the axis 7 of the fluid conduit 4.

Figure 8:
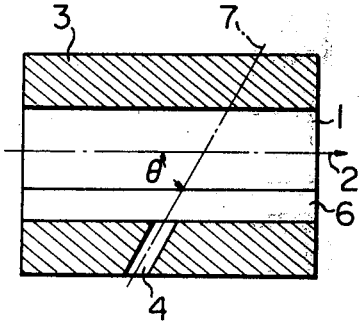
FIG. 8 is a longitudinal cross-sectional view of still further modified embodiment of the interlacing nozzle according to the present invention.

In the interlacing nozzles identified by G and H, the angle $\theta$ formed between the axis 7 of the fluid conduit 4 and the axis 2 of the yarn passage 1, which corresponds to the angle between the yarn running direction and the fluid jetting direction, was inclined as shown in FIG. 8.

Figure 2:
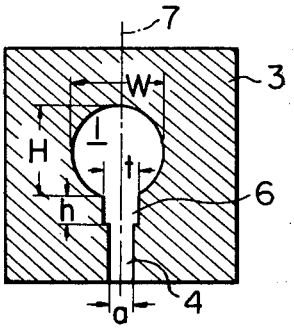
FIG. 2 is a cross-sectional view of the interlacing nozzle, lateraly taken along the axis of the fluid supply conduit in FIG. 1.

The interlacing nozzles identified by A, B and E had cross sections as illustrated in FIGS. 1 and 2.

The interlacing nozzles identified by C and D had cross sections as illustrated in FIGS. 1 and 7.

Figure 9:
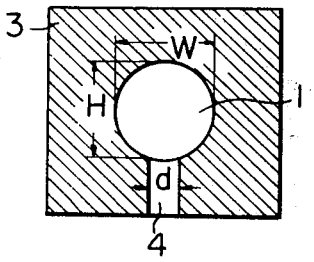
Fig. 9 PRIOR ART
FIG. 9 is a lateral cross-section of a known nozzle.

The interlacing nozzle identified by F is a known apparatus having a cross section as shown in FIG. 9.

The interlacing nozzle identified by G had cross sections as illustrated in FIGS. 7 and 8.

The interlacing nozzle identified by H had the known cross section shown in FIG. 9 and the angle $\theta$ formed between the axis 2 of the yarn passage 1 and the axis 7 of the fluid conduit 4, which corresponds to the angle between the yarn running direction and the fluid jetting direction, was adjusted to 60° as shown in FIG. 8, for example.

TABLE 1

| Apparatuses used in Examples | Type of interlacing nozzle | | | | | | | |
|---|---|---|---|---|---|---|---|---|
| | A | B | C | D | E | F | G | H |
| Yarn passage diameter W (mm) | 1.5 | 1.5 | 1.5 | 1.5 | 3.0 | 1.5 | 1.5 | 1.5 |
| Width t (mm) of rectifying and diffusing portion 6 | 0.8 | 0.8 | 0.8 | 1.0 | 1.0 | — | 0.8 | — |
| Height h (mm) of rectifying and diffusing portion 6 | 0.7 | 0.4 | 1.3 | 0.7 | 0.8 | — | 0.7 | — |
| Length l (mm) of rectifying and diffusing portion 6 | 10 | 10 | 5 | 10 | 10 | — | 10 | — |
| Diameter d (mm) of fluid conduit 4 | 0.8 | 0.8 | 0.8 | 1.0 | 0.8 | 0.8 | 0.8 | 0.8 |
| Length L (mm) of yarn passage 1 | 10 | 10 | 5 | 12 | 10 | 10 | 10 | 10 |
| Width S (mm) of slit for threading the yarn into the yarn passage 4 | — | — | 0.1 | 0.1 | — | — | 0.1 | — |

EXAMPLE 1

Polyethylene terephthalate multifilament yarn was spun at a spinning wheel of 3000 m/min to produce an undrawn yarn of 250 denier/48 filaments. The undrawn multifilament yarn was subjected to the conventional draw-false twisting treatment and then subjected to the fluid treatment by means of the apparatus shown in FIG. 10, wherein the interlacing nozzle according to the present invention was applied. To ascertain the functional effect of the interlacing nozzle according to the present invention, the type A and F nozzles were employed.

Figure 10:
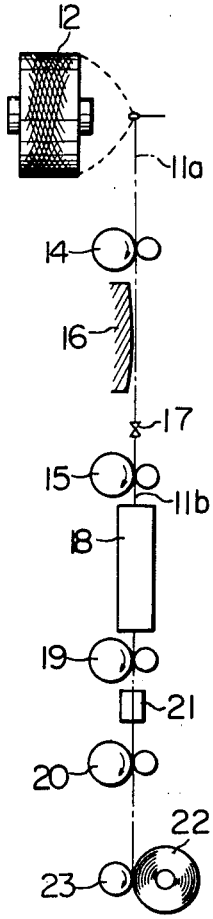
FIG. 10 is a schematic side view of a false twisting apparatus and an interlacing apparatus arranged in successive condition.

In this embodiment, the false twisting operation and the interlacing treatment operation are carried out in one process as shown in FIG. 10. That is, an undrawn yarn 11*a* is supplied from a yarn package 12 onto the draw-false twisting apparatus comprising a pair of feed rollers 14, a pair of delivery rollers 15, a heater 16 and a false twisting spindle 17 successively disposed in a zone of the yarn passage between the rollers 14 and 15; then the thus produced false twisted multifilament yarn 11*b* is supplied into the interlacing treatment apparatus, comprising a pair of feed rollers 19, a pair of delivery rollers 20, an interlacing nozzle 21 disposed between the rollers 19 and 20, after passing through a heater 18; and, finally, the thus produced multifilament yarn is wound on a package 22 by means of a takeup device 23.

The draw-false twisting treatment was carried out under conditions shown in Table 2.

TABLE 2

| | Bulky yarn having torque-property | Non-torque bulky yarn |
|---|---|---|
| Draw ratio | 1.7 | 1.7 |
| First heater 16 temperature (°C.) | 210 | 210 |
| Second heater 18 temperature (°C.) | — | 190 |
| Relaxation ratio in the zone between the rollers 15 and 19 | — | 10 |
| False twists (t/m) | 2450 | 2450 |
| Processing speed (m/min) | 200 | 200 |

A warp was warped directly from the yarn packages 22 on which the so prepared interlaced yarn had been wound, and 20 pieces of fabric, each having a 50 m length, were woven by a water jet loom in such a condition that the above-mentioned warp yarn was not provided with any additional twist or sizing.

A crimped yarn wound by using the apparatus shown in FIG. 10 without applying the interlacing treatment was used as the weft.

A plain weave fabric having 96 warps per inch and 88 picks per inch was produced under a weaving condition of 360 ppm and an average warp tension 45 g/yarn. The weaving adaptability was evaluated based on the number of fluffs formed on warps per piece. The weaving adaptability aimed at in the present invention is one fluff per piece or lower. The results of the measurement of the interlacing degree in the interlaced crimped multifilament yarn and the weaving adaptability are shown in Table 3.

TABLE 3

| Identification number of the experiment | Weaving adaptability (fluffs per piece) | Yarn type | Fluid treatment nozzle (type) | Pressure ($kg/cm^2G$) of compressed air as fluid | Treatment tension (g) (tension at nozzle inlet) |
|---|---|---|---|---|---|
| 1 | 6.5 | Bulky yarn | A | 1.0 | 3.0 |
| 2 | 5.5 | Bulky yarn | F | 5.0 | 3.0 |
| 3 | 0.7 | Bulky yarn | A | 2.5 | 3.0 |
| 4 | 3.2 | Bulky yarn | A | 2.5 | 1.0 |
| 5 | 8.0 | Non-torque yarn | A | 1.0 | 3.0 |
| 6 | 0.8 | Non-torque yarn | A | 2.5 | 3.0 |

In the actual weaving operation, repeated stretching is imparted to the warp several thousand times. To test the durability of the interlaced condition of the multifilament yarn produced by the above-mentioned apparatus, a repeated stretching treatment was applied to a test piece of the interlaced multifilament yarn. That is, a ten times repeated stretching treatment was applied to the test piece under a tension of 0.5 g/d, which is much higher than the tension applied during the actual weaving operation. The interlacing degree of the interlaced multifilament yarn produced as mentioned above, and interlacing uniformity thereof were then measured.

The above-mentioned repeated stretching treatment and measurement of the degree of interlacing were carried out as hereinafter explained.

A sample yarn with an 800 mm test length was mounted on an "Instron Universal Tensile Tester" under a tension of 0.05 g/d. The sample yarn was stretched to a predetermined stretched condition and, then, the sample yarn was unloaded so as to return its test length to 800 mm. This cycle of stretch action and relaxation action was repeated continuously ten times. The load needed to stretch the sample yarn to the predetermined stretched condition at the first time is hereinafter referred to as the "repeated stretching tension". In the above-mentioned repeated stretching and relaxation operation, the head speed of the grip of the tester was maintaned at 1000 m/min.

Figure 11:
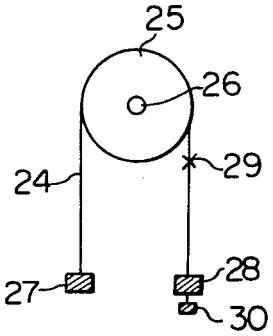
FIG. 11 is a schematic front view of an instrument to measure the degree of interlacing of the interlaced multifilament yarn.

The method for measuring the above-mentioned degree of interlacing was similar to the method disclosed in the Japanese Patent Application Ser. No. 136147/1974. Therefore, this method will now be briefly explained. Referring to FIG. 11, a sample yarn 24 is hung on a grooved pulley 25 mounted for rotation both to the left and right around a central shaft 26 without resistance, so that slippage is not caused in the sample yarn 24, and two loads 27 and 28 are imposed on the sample yarn. The weight of the loads is adjusted to (0.2×total denier of the sample) g. A fixing needle 29 having an outer diameter of 0.60 mm is pierced among the individual filaments of the sample yarn 24 substantially perpendicularly thereto and the needle is fixed. A weight 30 of (1 gram×denier of the individual filament) is placed on the load 27 imposed on the left side of the sample yarn, consequently the sample yarn is moved toward the left side until the interlaced portion of the yarn is caught by the needle 29 so that the above mentioned displacement of the yarn is stopped. Then, the weight 30 is removed from the load 27 and placed on the right load 28 as shown in FIG. 11, and the sample yarn 24 is moved toward the right side until the interlaced portion thereof is caught by the needle 29 so that the displacement of the sample yarn 24 is stopped. The moving speed of the sample yarn by the weight 30 is adjusted to 1 cm/sec. The distance×(mm) of the movement of the sample yarn toward the right side is measured and the value of the interlacing degree is calculated according to the following formula:

$$\text{Degree of interlacing} = 1000/(x+0.60)$$

The above measurement is repeated 1000 times and an average value is calculated.

Figure 12:
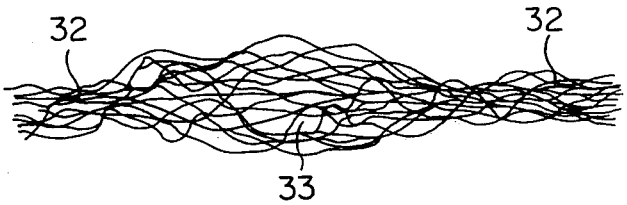
FIG. 12 is an enlarged elevation of one example of the interlaced multifilament yarn produced according to the present invention.

As can be understood from the above-described test utilizing the device shown in FIG. 11, the interlaced multifilament yarn produced by the apparatus according to the present invention is provided with such a yarn configuration that numerous interlaced portions having a configuration of effectively interlaced individual filaments are uniformly distributed along the yarn axis and an opened portion having opened configuration of individual filaments separated from each other is formed between two adjacent interlaced portions. However, according to our careful observation of the configuration of the yarn produced by the apparatus according to the present invention, it was confirmed that, in the above-mentioned opened portions, the individual filaments are somewhat interlaced with each other. Such interlaced condition of the yarn is shown in FIG. 12, wherein the interlaced portions of the yarn and the opened portions are represented by 32 and 33, respectively.

The interlacing uniformity of the multifilament yarn is evaluated by measuring the length of yarn portion where the individual filaments are separated. This yarn portion is hereinafter referred to as an opened yarn portion. It is pertinent to define the length of the opened yarn portion as x+0.60, where x is the distance of the movement of the sample yarn in the above-mentioned measurement test, and the ratio (in %) of (number of opened yarn portions having a length exceeding 1.5 times the average length of the opened yarn portions)/(number of opened yarn portions) is used to measure variation of the interlacing effect imparted to the multifilament yarn. Consequently, it can be understood that the larger the above-mentioned ratio, the poorer the uniformity of the interlacing.

The degree of interlacing (hereinafter represented by CF value) variation of the interlacing effect of the interlaced multifilament yarns shown in Table 2 are shown in Table 4.

TABLE 4

| Identification number of the experiment | Degree of interlacing (CF value) | Degree of interlacing after repeated stretching treatment under 0.5 g/d | Variation of the interlacing effect in % |
|---|---|---|---|
| 1 | 48 | 42 | 19.6 |
| 2 | 118 | 107 | 23.2 |
| 3 | 128 | 272 | 12.5 |
| 4 | 106 | 125 | 34.2 |
| 5 | 36 | 32 | 20.0 |
| 6 | 80–114 | 206 | 5.0 |

The Experiments 1 and 5 were comparative experiments conducted to definitely illustrate the effect of the present invention. In yarns obtained in these experiments, the interlacing degree (CF value) was lower than 60 and was not increased by the repeated stretching treatment, and therefore, these yarns were inferior in weaving adaptability.

The Experiment 2 was a comparative experimental test using a known nozzle of type F. The CF value of the yarn obtained in this experiment was higher than 80, but the CF value was not increased by the repeated stretching treatment and the variation of the interlacing effect exceeded 20%, that is, the interlacing uniformity was low and the weaving adaptability was inferior.

In the Experiment 2, when vibration of the yarn in the operational zone of the interlacing treatment was observed by a stroboscope, it was found that the direction of the vibration was random. In the Experiment 4, even though the fluid treatment nozzle of the type A was used, the tension imparted to the yarn in the interlacing treatment was very low. Accordingly, the running condition of the yarn was unstable and, when observed by a stroboscope, it was found that the direction of the vibration of the individual filaments was random. In the resulting yarn, well interlaced portions and non-interlaced portions were randomly distributed along the yarn axis, and the CF value was high and was increased by the repeated stretching treatment. However, since the variation of the interlacing effect was more than 30%, the interlacing uniformity was low and the yarn was very inferior in the weaving adaptability.

In each of the interlaced multifilament yarns obtained in the Experiments 3 and 6 according to the present invention, the running condition of the yarn was very stable in the operational zone of the interlacing treatment and, when observed by a stroboscope, the individual filaments of the yarn vibrated substantially in the direction parallel to the plane defined by the yarn running direction and the fluid jetting direction. These interlaced multifilament yarns were very excellent in interlacing uniformity and had a very good weaving adaptability. Fabrics prepared by using these interlaced multifilament yarns as warps had high quality and good bulkiness and were free of such defects as stripe and grazing.

Figure 13:
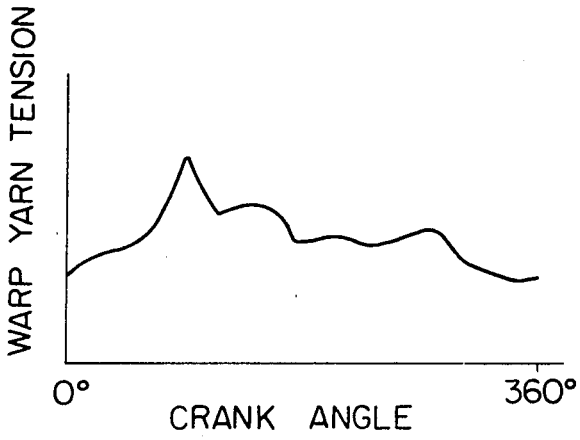
FIG. 13 is a schematic diagram indicating how warp yarn tension changes during one cycle of the crank motion in the weaving operation.

From the above-mentioned results of the series of Experimental tests 1 to 6, it was found that when the interlacing treatment utilizing the apparatus according to the present invention is applied to the false twisted multifilament yarn, the degree of interlacing (CF value) of the interlaced multifilament crimped yarn is remarkably increased by the repeated stretching action. This property of the yarn is very important in that it allows the yarn to be used as a warp yarn without any additional twisting or sizing operation for weaving a fabric. This is because repeated stretch actions are imparted to each warp yarn, and in each cycle of the stretch actions, the tension imparted to each warp yarn varies as shown in FIG. 13. In FIG. 13, the ordinate represents a tension imparted to the warp while the abscissa represents a crank angle in one complete cycle of a crank shaft, consequently, if the interlaced individual filaments of the warp yarn are separated or the interlaced condition thereof is weakened by the above-mentioned repeated stretch action during the weaving operation, many problems such as breakage of warp yarns, excess scratching of the warp yarn, by heald or reed of the power loom, creation of damaged appearance of fabric, etc., can not be avoided. However, since the interlaced multifilament yarn produced by the apparatus according to the present invention has a superior property of increasing the degree of interlacing by the application of the repeated stretching action, it was proved that the above-mentioned interlaced multifilament yarn is very useful as a warp yarn without any additional twists or sizing operation, for producing fabric. According to the repeated experimental tests in a similar condition to the above-mentioned Experiments 3 and 6, it was found that, the following conditions are pertinent to attain the purpose of the present invention. That is, the degree of interlacing must be at least 80, the degree of interlacing is increased more than 1.2 times the degree of interlacing before repeated stretching, by the repeated stretching action conducted under a tension of 0.1 to 1.0 g/d, and the variation of the interlacing effect is less than 20%.

EXAMPLE 2

The same undrawn polyethylene terephthalate multifilament yarn as used in Example 1 was subjected to the draw-false twisting treatment by the apparatus shown in FIG. 10 wherein a tri-axial outer contact type rubbing false twister was utilized instead of the conventional false twisting spindle. The yarn processed was of the bulky torque yarn type. In this false twisting device, the frictional rubbing-members used were:

a. ceramic having a surface roughness of 7S (Japanese Industrial Standard):

b. rubber having a hardness of 95, and;

c. a combination of the above-mentioned a and b.

The draw-false twisting operations were carried out under the conditions shown in Tables 5 and 6.

TABLE 5

| | |
|---|---|
| Processing speed | 400 m/min |
| First heater temperature | 210° C. |
| Number of false-twist | 2420 t/m |
| Draw ratio | 1.8 |

TABLE 6

| Frictional rubbing member | Yarn speed ratio |
|---|---|
| a | 0.54 |
| b | 0.57 |
| c | 0.57 |

The yarn speed ratio shown in Table 6 is a ratio of the running speed of the yarn to the speed on the frictional rubbing surface.

After the above draw-false twisting operations, the resulting yarn was subjected to the fluid treatment using a fluid treatment nozzle of the type D and wound on a yarn package. The fluid treatment conditions were as shown in Table 7.

TABLE 7

| | |
|---|---|
| Pressure of compressed air | 4.0 kg/cm$^2$G |
| Treatment tension (tension at nozzle inlet) | 3 g |
| Amount consumed of compressed air | 2.6 Nm$^3$/hr |

The results of the measurement of the degree of interlacing (CF value) in the so obtained interlaced multifilament yarns are shown in Table 8.

TABLE 8

| Identification number of the experiments | Frictional rubbing member | Degree of interlacing (CF value) | Weaving adaptability (fluffs per piece) |
|---|---|---|---|
| 7 | a | 254 | 0.5 |
| 8 | b | 176 | — |
| 9 | c | 223 | 0.3 |

In interlaced yarns obtained by using frictional rubbing members a and c according to the present invention, a much higher degree of interlacing could be attained than in the comparative yarn prepared by using the comparative frictional rubbing member b.

The interlaced yarn prepared by using the frictional rubbing member a or c was warped directly from its yarn package and subjected to non-twist and non-sizing weaving to form a fabric of Melon-Amunzen Weave having 82 warps per inch and 62 wefts per inch. The same crimped yarn as described above was used as the weft without the interlacing treatment. In each case, the weaving adaptability was lower than one fluff per piece and no broken texture was observed. Further, such defects as napping and pilling were not caused at all. Each fabric had an excellent feel to the hand and bulkiness.

From the above-mentioned experimental tests, it was confirmed that the false twisting method applying the rubbing technique is very useful for producing the interlaced multifilament yarn by means of the apparatus according to the invention. That is, the interlaced multifilament yarn of this preferred type is prepared according to a process comprising rubbing and scratching the surface of a running thermoplastic multifilament yarn with a rotary rough surface member having sharp projection ends smaller than the diameter of the yarn-constituting individual filaments and, then, subjecting the surface-roughened multifilament yarn to the interlacing treatment using a fluid.

The rough surface member must be such as will impart proper scratches on the filament surfaces, namely scratches capable of improving the interlacing condition but not causing such reduction of tensile strength and elongation as will bring about any problems during the weaving or knitting operations.

The rough surface member must have a rough surface including sharp projection ends smaller than the diameter of the yarn-constituting individual filaments. More specifically, the rough surface member is appropriately chosen from materials coated with ordinary ceramics or carbide type compounds.

Formation of random scratches on the individual filament surfaces can be accomplished by a treatment method in which a thermoplastic synthetic multifilament yarn is rubbed with the surface of a rough surface member such as mentioned above while false twisting is carried out. By effecting false twisting during this treatment, in the treated multifilament yarn a so-called migration condition is created where yarn-constituting individual filaments are positioned randomly in the inner and outer portions of the yarn. Accordingly, each individual filament is present on the surface portion of the yarn intermittently with respect to the yarn axis and, hence, the scratching treatment is made intermittently on respective individual filaments.

When the so scratched multifilament yarn is subjected to the interlacing treatment using a fluid, since the yarn is randomly scratched, if an excessive fluid is jetted, problems such as yarn breakages are readily caused. Therefore, it is preferable to use an effective apparatus capable of imparting sufficient interlacing with the jetting of a much reduced amount of a fluid.

EXAMPLE 3

Figure 15:
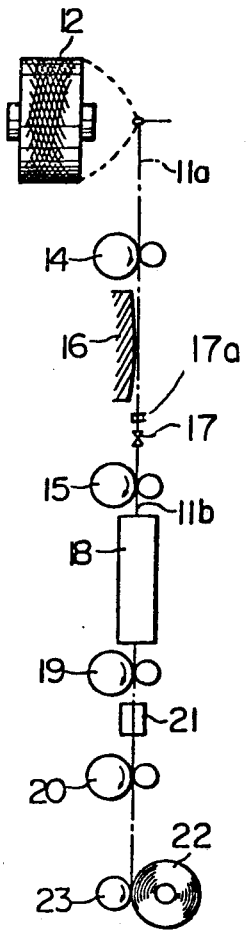
FIG. 15 is a schematic side view of a modification of the false twisting apparatus and interlacing apparatus, according to the invention, which is utilized in Example 3, and is generally the same as the apparatus of FIG. 10 except that rubbing member 17*a* is disposed just upstream of the false twisting spindle 17.
Figure 16:
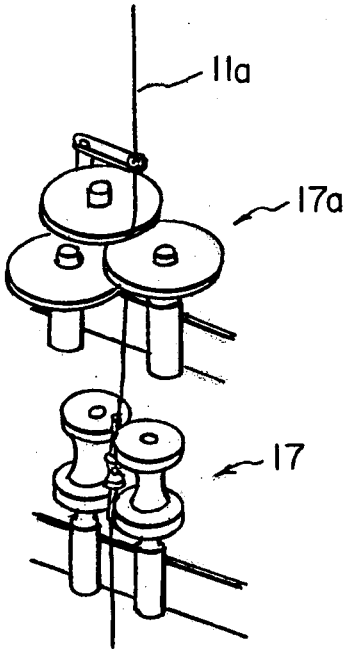
FIG. 16 is a perspective view of the rubbing member as well as the conventional false twisting spindle.

The same undrawn polyethylene terephthalate yarn as used in Example 1 was subjected to the draw-false twisting treatment under processing conditions shown in Table 9 by using the apparatus shown in FIGS. 15, 16, in which a conventional false twisting spindle was used. The same ceramic rubbing member as used in Example 2 was disposed just upstream of the false twisting spindle. Specifically, reference is made to FIGS. 15 and 16 which shows rubbing member 17*a* upstream of spindle 18. The yarn processed was of the crimped yarn type having torque and bulkiness.

TABLE 9

| | |
|---|---|
| Processing speed | 200 m/min |
| First heater temperature | 210° C. |
| Number of the false twist | 2450 t/m |
| Draw ratio | 1.7 |
| Rotation number of rubbing member | 4000 rpm |

Then, the processed yarn was subjected to the fluid treatment operation using the same interlacing nozzle of the type D as used in Example 2 and wound on a yarn package. The fluid treatment was carried out in the conditions shown in Table 10.

TABLE 10

| | |
|---|---|
| Pressure of compresed air | 2.5 $Kg/cm^2G$ |
| Treatment tension (tension at nozzle inlet) | 3 g |
| Amount consumed of compressed air | 1.0 $Nm^3/hr$ |

The degree of interlacing CF value in the resulting yarn was as shown in Table 11. For comparison purposes, the datum of the interlacing degree CF value obtained in the Experiment 3 of Example 1, where no frictional rubbing member was used, is also shown in Table 11.

TABLE 11

| Identification number of the experiments | Rubbing member | Degree of interlacing (CF value) |
|---|---|---|
| 10 | used | 158 |
| 3 (Example 1) | not used | 128 |

As will be apparent from the above results, the interlaced multifilament yarn produced by using the frictional rubbing member had a higher degree of interlacing than the comparative yarn prepared without using the frictional rubbing member.

The results of experiments conducted using various apparatuses, so as to examine the effect of the rectifying and diffusing portion according to the present invention, are hereinafter described.

EXAMPLE 4

Polyethylene terephthalate multifilament yarn was spun at 1000 m/min and drawn at a rate of 600 m/min by a hot pin to obtain a drawn polyester multifilament yarn having 50 denier and 18 filaments. The drawn yarn 34 was fed into the apparatus shown in FIG. 14 and was subjected to the interlacing treatment by a fluid treatment apparatus 37, disposed between yarn feed rollers 35 and delivery rollers 36, under conditions of a treatment speed of 600 m/min, a treatment tension (tension at nozzle inlet) of 2 g and a compressed air pressure of 2 Kg/cm$^2$G. Fluid treatment nozzle of the types A and F shown in Table 1 were employed.

Each of the resulting interlaced multifilament yarns was subjected as the warp to non-twist and non-sizing weaving, utilizing a water jet loom at a rotation number of 360 rpm, to obtain a plain weave fabric having 112 warps per inch and 82 wefts per inch.

The interlacing degree (CF value) of the interlaced multifilament yarn and the weaving adaptability (fluffs per piece of fabric) were as shown in Table 12.

A polyethylene terephthalate multifilament yarn of 75 denier and 36 filaments prepared by winding at 3000 m/min by DSD was used as the weft.

TABLE 12

| Identification number of the experiment | Interlacing nozzle type | Degree of interlacing CF value | Weaving adaptability (fluffs/piece) |
|---|---|---|---|
| 12 | A | 24 | 0.8 |
| 13 | F | 8 | 1.5 |

EXAMPLE 5

The same undrawn polyethylene terephthalate multifilament yarn as used in Example 1 was wound by using the apparatus shown in FIG. 10 without conducting the fluid treatment. The false twisting conditions were the same as in Example 1.

Figure 14:
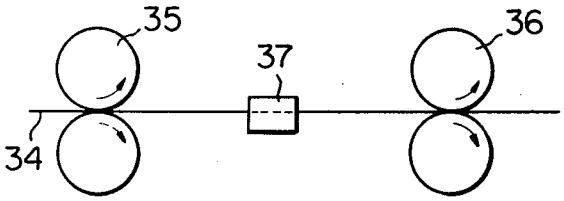
FIG. 14 is a schematic front view of an apparatus for carrying out the interlacing treatment of the multifilament yarn, according to the present invention.

In the same manner as in Example 4, the undrawn yarn was subjected to the interlacing treatment by using various nozzles in the apparatus shown in FIG. 14. The interlacing treatment was carried out under such conditions as, a processing speed of 400 m/min, a treatment tension (tension at nozzle inlet) of 3 g and a compressed air pressure of 3 Kg/cm$^2$G. Fluid treatment nozzles A to H shown in Table 1 were employed. In the nozzles according to the present invention, dimensions were different as indicated in Table 1 and nozzles including a slit for threading the yarn into the yarn passage, as shown in FIG. 7, were also employed. Nozzles F and H were comparative nozzles having a known section.

The degree of interlacing, CF values of the resulting interlaced multifilament yarns are shown in Table 13.

Fabrics were prepared in the same manner as in Example 1 by using yarns obtained in the Experiments 14 and 19 as the warp, and the weaving adaptability of each yarn was examined to obtain the results shown in Table 14.

TABLE 13

| Identification number of the experiments | Nozzle type | Degree of interlacing CF value |
|---|---|---|
| 14 | A | 146 |
| 15 | B | 155 |
| 16 | C | 95 |
| 17 | D | 188 |
| 18 | E | 84 |
| 19 | F | 25 |
| 20 | G | 132 |
| 21 | H | 22 |

TABLE 14

| Identification number of the experiments | Weaving adaptability (fluffs/piece of fabric) |
|---|---|
| 14 | 0 |
| 19 | 48 |

In the Experiments 14 to 18 and 20 using a nozzle of the present invention including the rectifying and diffusing portion, as will be apparent from the above results, a much higher degree of interlacing than in comparative Experiments 19 and 21 could be attained.

It will readily be understood from the results obtained in the Experiments 20 and 21, that even if the fluid jetting angle was changed, a high effect of enhancing the degree of interlacing could similarly be attained by provision of the rectifying and diffusing portion.

What we claim is:

1. Method for producing an interlaced multifilament yarn comprising, in combination:

previously rubbing and scratching a material multifilament yarn with such intensity that individual filaments constituting said filament yarn are not substantially broken by a rotary rough surface member having sharp projections which are smaller than the cross-sectional diameter of the individual filaments of said material yarn;

then diffusing at least one jetted fluid, jetted in the yarn running direction along a predetermined yarn passage from a jetting aperture of a supply conduit through a nozzle formed with a rectifying and diffusing portion having a substantially uniform cross-section of limited axial extent formed only in the vicinity of said jetting aperture, and the width of said jetting aperture being smaller than said rectifying and diffusing portion, said supply conduit being fixed with respect to members defining said yarn passage, said fluid being diffused along a direction parallel to said yarn passage in said rectifying and diffusing portion; and impinging said diffused jetted fluid against said running material multifilament yarn so that said individual filaments of said multifilament yarn mostly vibrate in a direction substantially parallel to a plane defined by the yarn running direction and the fluid jetting direction, the vibration taking place in a section of said yarn passage facing said rectifying and diffusing portion.

2. Method for producing an interlaced multifilament yarn according to claim 1, wherein said predetermined yarn passage is defined by contacting members disposed at an upstream and a downstream position of the working position of said jetted fluid.

3. The method of claim 1 or 2, wherein said rectifying and diffusing portion has an opening communicating with said yarn passage, said opening having a length l extending along the yarn running axis and a width t in a direction parallel to a plane where the axis of said conduit passes perpendicularly, said width t being less than $\frac{1}{3}$ of said length l; the height h of said rectifying and diffusing portion being from 0.3 to 20×t; the maximum width W of said yarn passage being from 1.2t to 10t.

4. Method for producing an interlaced multifilament yarn according to claim 1 or 2, wherein a single jetted fluid is utilized for interlacing individual filaments of the supplied multifilament yarn.

5. Method for producing an interlaced multifilament yarn according to claim 1 or 2, further comprising false twisting said material yarn at an upstream position to the working position of said rotary rough surface member and jetted fluid.

* * * * *